US006031346A

United States Patent [19]

Shirai et al.

[11] Patent Number: 6,031,346

[45] Date of Patent: Feb. 29, 2000

[54] CATHODE RAY TUBE WITH LOW DYNAMIC CORRECTION VOLTAGE

[75] Inventors: Shoji Shirai, Mobara; Kenichi Watanabe, Isumi-gun, both of Japan

[73] Assignee: Hitachi, Ltd., Tokyo, Japan

[21] Appl. No.: 09/089,129

[22] Filed: Jun. 2, 1998

Related U.S. Application Data

[63] Continuation of application No. 08/790,060, Jan. 28, 1997, Pat. No. 5,828,191, which is a continuation of application No. 08/262,975, Jun. 21, 1994, Pat. No. 5,610,481.

[30] Foreign Application Priority Data

Jun. 30, 1993 [JP] Japan ..... 5-161913

[51] Int. Cl.[7] ..... G09G 1/04; H01J 29/58; H01J 29/50

[52] U.S. Cl. ..... 315/382; 315/382.1; 313/414

[58] Field of Search ..... 315/382, 382.1; 313/414

[56] References Cited

U.S. PATENT DOCUMENTS

| | | | |
|---|---|---|---|
| 5,061,881 | 10/1991 | Suzuki et al. | 315/382 |
| 5,212,423 | 5/1993 | Noguchi et al. | 313/414 |
| 5,384,512 | 1/1995 | Kamohara et al. | 313/414 |
| 5,449,983 | 9/1995 | Sugawara et al. | 315/382 |
| 5,517,078 | 5/1996 | Sugawara et al. | 313/412 |
| 5,523,648 | 6/1996 | Son et al. | 313/414 |

FOREIGN PATENT DOCUMENTS

| | | |
|---|---|---|
| 58-103752 | 6/1983 | Japan . |
| 4-043532 | 2/1992 | Japan . |
| 4-43532 | 2/1992 | Japan . |

*Primary Examiner*—Edward P. Westin
*Assistant Examiner*—Nikita Wells
*Attorney, Agent, or Firm*—Antonelli, Terry, Stout & Kraus, LLP

[57] ABSTRACT

To correct a deterioration by a deflection aberration of an electron beam spot at a peripheral portion of an image plane and to promote the resolution, a cathode ray tube is proposed which is composed of an acceleration electrode 32 and a first kind and a second kind of focusing electrode group 311, 313, 312 and 314 which are applied with a first and a second focusing voltage, wherein a first electron lens in which a first focusing force for focusing the electron beam in the horizontal direction is always stronger than a second focusing force for focusing in the vertical direction, and a second electron lens wherein the focusing force for focusing the electron beam in the horizontal direction or in the vertical direction is stronger than the other depending on the relative sizes of a first focusing voltage applied on the first kind of focusing electrode group and a second focusing voltage applied on the second kind of focusing electrode group, are formed among the first kind and the second kind of electrode group, and a dynamic voltage which changes in accordance with a deflection amount of the electron beam is superposed on a constant voltage, in either one of the first and the second focusing voltage.

30 Claims, 6 Drawing Sheets

CATHODE RAY TUBE WITH LOW DYNAMIC CORRECTION VOLTAGE

CROSS-REFERENCE TO RELATED APPLICATIONS

This application is a continuation of application Ser. No. 08/790,060 filed Jan. 28, 1997 (now U.S. Pat. No. 5,828,191); which is a continuation of application Ser. No. 08/262,975 filed Jun. 21, 1994 (now U.S. Pat. No. 5,610,481), the entire disclosures of which are hereby incorporated by reference.

BACKGROUND OF THE INVENTION

The present invention relates to a cathode ray tube having an electron gun equipped with a main lens having a function of controlling a shape of an electron beam spot which is deflected to the peripheral portion of an display screen, to improve a resolution at the peripheral portion of the screen of the cathode ray tube for use in a direct view color television receiver or a color display terminal.

The cathode ray tube which is utilized in color display of a direct view type or projection type television receiver, display terminal device and the like, is composed of a panel portion that is an image screen, a neck portion accommodating an electron gun, and a funnel portion for connecting the panel portion and the neck portion. A deflection yoke is attached to the funnel portion for scanning an electron beam emitted from the electron gun on a phosphor screen that is formed on an inner face of the panel portion.

The electron gun which is accommodated in the neck portion is provided with an electron beam generating unit having a cathode for generating the electron beam and a control electrode for controlling the electron beam, and a main lens unit comprising various electrodes for focusing, accelerating and converging the controlled electron beam.

The electron beam emitted from the cathode is modulated by signals applied on the control electrode or the cathode, and is directed onto the phosphor screen after being formed into a required sectional shape and provided with a required energy by the main lens electrodes.

FIG. 5 shows a schematic sectional diagram for explaining an example of the structure of the color cathode ray tube, of which shape of the electron gun portion is exaggerated for the purpose of explanation.

In FIG. 5, the electron gun accommodated in the neck portion is composed of the electron beam generating unit and the main lens unit which accelerates and focuses the electron beam generated from the electron beam generating unit and the electron beam is made to impinge on a phosphor screen 3 composed of three color phosphor materials which are coated and formed on an inner wall of a faceplate portion 2 composing a glass envelope 1.

The electron beam generating unit is composed of cathodes 7, 8 and 9, a first grid electrode (G1)10, and a second grid electrode (G2) 30. The electron beams which have been emitted from the cathodes 7, 8 and 9, are radiated along center axes 35, 36 and 37 which are disposed approximately in parallel with each other in a common plane (in the horizontal direction) and are incident on the main lens unit after passing through the first grid electrode 10 and the second grid electrode 30.

The main lens unit is composed of a third grid electrode (G3) 31 that is one main lens electrode, a fourth grid electrode (G4) 32 and a shield cup electrode 33. The center axes of electron beam passing holes 70, 71, 72, 76, 77 and 78 which are formed in the third grid electrode (G3) 31 and the shield cup electrode 33, are on the center axes 35, 36 and 37, respectively.

Further, the center axis of a central electron beam passing hole 74 of the fourth grid electrode 32 which is the other main lens electrode, is on the center axis 36. However, the center axes 38 and 39 of side electron beam passing holes 73 and 75 are not on the center axes 35 and 37, and are slightly displaced from the center axes 35 and 37 toward the outside, respectively.

In operation, the potential level of the third grid electrode 31 is set lower than that of the fourth grid electrode 32. The fourth grid electrode 32 and the shield cup electrode 33 having a high potential level is connected to a conductive film 5 such that the potential level thereof is equal to that of the conductive film 5 that is coated on the inner face of the funnel portion by a conductive spring or the like, not shown.

Since the center electron beam passing holes of the third grid electrode 31 and the fourth grid electrode 32 are coaxial, an axisymmetric main lens is formed at the central portions of the two electrodes, and the central electron beam is focused by the main lens and proceeds straight on a trajectory along the axis.

On the other hand, since the axes of the side electron beam passing holes of the two electrodes are deviated from each other, a non-axisymmetric main lens is formed at the side. Therefore, the outside electron beams pass through locations which are deviated from the center axes of the lens toward the central electron beam in a diverging lens region that is formed on the side of the fourth grid electrode 32, in the main lens region, and receive a focusing action by the main lens and at the same time a converging force toward the central electron beam.

In this way, the three the electron beams are focused and at the same time converged on a shadow mask 4 to be overlapped. This converging action is called a static convergence.

The electron beam receives a color selection at an opening of the shadow mask so that only a portion thereof passes through the opening to excite a phosphor of a color corresponding to the respective electron beam.

Further, the deflection yoke 6 deflects and scans the electron beam on the phospher screen in the horizontal and vertical directions thereby forming a two-dimensional image on the phosphor screen.

Conventionally, an electron gun for a color picture tube having a so-called electrostatic quadrupole lens has been proposed to improve a resolution at a peripheral portion of the screen.

In the electron gun of this type, the cathode, the first grid electrode and the second grid electrode compose the electron beam generating unit, a plurality of electron beams are emitted from the electron beam generating unit along initial paths which are arranged approximately in parallel with each other in a horizontal plane, and are incident on the main lens unit composed of the focusing electrode, the accelerating electrode and the shield cup electrode.

The focusing electrode composing the main lens unit is composed of a first member and a second member, and the electrostatic quadrupole lens is composed by opposing an aperture electrode provided in the first member and planar correction electrodes provided in the second member.

The acceleration electrode is impressed with a final accelerating voltage of 20 through 35 kV that is the highest voltage. Further, a first focusing voltage is applied on the focusing electrode, which is normally a constant voltage of 5 through 10 kV.

On the other hand, a second focusing voltage is applied on the second member of the focusing electrode. The second focusing voltage comprises a constant voltage superposed by a dynamic correction voltage that changes in synchronism with a deflection amount of the electron beam.

The resolution at the peripheral portion of the screen of a color cathode ray tube is considerably improved by using the above electron gun. That is, a correction is performed wherein an astigmatism which elongates in the horizontal direction the electron beam spot that is deflected to the peripheral portion of the screen owing to a self-convergent magnetic deflection field and another astigmatism that elongates the electron beam formed by the electrostatic quadrupole lens in the vertical direction cancel each other.

The distance from the main lens to the center of the screen and the distance from the main lens to the peripheral portion of the screen are different. Therefore, when the electron beam is focused at the center of the image plane in an optimum condition, the focusing condition is deviated from the optimum condition at the peripheral portion of the screen, and this is a curvature-of-field aberration which brings about the deterioration in the resolution. The curvature-of-field aberration is corrected by the above-mentioned dynamic correction voltage, voltage is applied, the intensity of the main lens which is a final stage lens formed between the accelerating electrode and the second member of the above-mentioned focusing electrode, is reduced, the deflected electron beam can be optimally focused at the peripheral portion of the screen, and the curvature-of-field aberration as well as the astigmatism are corrected.

However, when the electron gun having this electrostatic quadrupole lens is employed, an electric circuit for generating the dynamic correction voltage is necessary, which increases the production cost especially when the dynamic correction voltage is high. Accordingly, it is necessary to improve a correction sensitivity in deflection aberration.

When the strength of the electrostatic quadrupole lens is increased, the correction sensitivity of the astigmatism in the deflection aberration can easily be improved. However, with respect to the curvature-of-field aberration, the correction sensitivity can not be easily improved, since the curvature-of-field aberration is corrected by the main lens. When the strength of the main lens is increased to improve the correction sensitivity for curvature-of-field aberration, it is not possible to focus the electron beam on the screen, even when the electron beam is not deflected.

Even when the correction sensitivity with respect to only the astigmatism is improved, an unbalance thereof with a curvature-of-field correction is caused which does not result in the reduction of the dynamic correction voltage.

Accordingly, a structure of an electron gun for reducing the dynamic correction voltage and reducing the production cost has been proposed.

FIG. 6 is a schematic diagram for explaining a structure of an electron gun for improving the correction sensitivity in the astigmatism at a low cost without reducing the correction sensitivity for curvature of field, wherein numeral 8 designates a cathode, numeral 10 designates a first grid electrode, numeral 30 designates a second grid electrode, numeral 31 designates a focusing electrode group composing a third grid electrode, numeral 32 designates a fourth grid electrode composing an accelerating electrode, and numeral 33 designates a shield cup electrode.

As shown in FIG. 6, the focusing electrode 31 is divided into a plurality of electrode members 31-1, 31-2, 31-3, 31-4, 31-5 and 31-6. Among the members of a focusing electrode group, in addition to an electrostatic quadrupole lens, at least one axisymmetrical lens is provided which has a function of a curvature-of-field correction lens. Further, the main lens is provided with a strong astigmatism which deforms the sectional shape of the electron beam into the vertically elongated shape. On this occasion, it is necessary to change direct voltage components of two focusing voltages in the above-mentioned conventional electron gun. However, the method of applying the dynamic correction voltage remains the same.

That is, in the conventional gun, the two direct focusing voltages are approximately the same value, and the dynamic correction voltage increases with an increase in the deflection amount of the electron beam. On the other hand, in the electron gun shown in FIG. 6, one of the two direct focusing voltages is considerably made larger than the other, and the difference in voltages is at least larger than the maximum value of the dynamic correciton voltage. In this way, the difference in potential in the axisymmetric lens is reduced and the strength of lens is also reduced when the deflection amount of the electron beam and therefore the dynamic correction voltage increase.

Accordingly, a force for focusing the electron beam is weakened in deflecting the electron beam thereby correcting the curvature-of-field aberration.

In this way, at least one curvature-of-field correction lens is added to the conventional curvature-of-field correction lens that is conventionally provided with only the main lens. Therefore, it is possible to reduce the dynamic correction voltage.

Further, it is possible to reduce a voltage necessary for correction, also with respect to the correction of the astigmatism, by increasing the intensity of the electrostatic quadrupole lens or by increasing the number thereof.

In this way, in the color cathode ray tube employing the electron gun of the type shown in FIG. 6, the dynamic correction voltage can be reduced and the increase in the cost of the circuit can be restrained.

The electron gun employing the above electrostatic quadrupole lens has been disclosed in Japanese Laid Open Patent Publication No. 43532/1992.

However, in the color cathode ray tube employing the electron gun disclosed in the Japanese Laid Open Patent Publication No. 43532/1992, there is the following problem owing to the structure of electrodes of the electron gun.

The effect of correction for curvature of field by the above axisymmetric lens is weak in comparison with the effect by the main lens. Therefore, the focusing electrode should be divided into a number of electrodes and a number of, or actually 4 or 5 axisymmetric lenses should be formed to considerably reduce the dynamic correction voltage.

This brings about a complicated structure of the electron gun and the requirement for the accuracy in manufacturing it is very severe.

SUMMARY OF THE INVENTION

It is an object of the present invention to solve the above problem of the conventional technology and to provide a cathode ray tube which reduces the dynamic correction voltage of an electron gun using an electrostatic quadrupole lens by a simple structure thereby reducing a deterioration due to the deflection aberration of the electron beam spot at the peripheral portion of the screen, and improving the resolution.

According to an aspect of the present invention, there is provided a cathode ray tube provided with an electron gun having at least an electron beam generating unit for generating a plurality of electron beams arrayed in a horizontal direction and for controlling said plurality of electron beams, comprising a main lens unit comprising a plurality of electrodes including a focus electrode and a final accelerating electrode for focusing said plurality of electron beams onto a fluorescent screen, said focus electrode comprising a plurality of electrode members, and said final accelerating electrode being disposed downstream of said focus electrode and adapted to be supplied with a first voltage; a final main lens formed between said final accelerating electrode and one of said plurality of electrode members adjacent to said final accelerating electrode; an electrostatic quadrupole lens formed in a first space between adjacent ones of said plurality of electrode members, one of said adjacent ones of said plurality of electrode members defining said first space being adapted to be supplied with a first focus voltage of a fixed value, another of said adjacent ones of said plurality of electrode members defining said first space being adapted to be supplied with a second focus voltage comprised of a fixed voltage and a dynamic voltage varying in synchronism with deflection of said plurality of electron beams, and. said electrostatic quadrupole lens being configured so as to focus said plurality of electron beams in one of the horizontal and vertical directions and to diverge said plurality of electron beams in another of the horizontal and vertical directions depending upon which is the higher of said first focus voltage and said second focus voltage; and a third electrostatic lens disposed between said final main. lens and said electrostatic quadrupole lens and formed in a second space between adjacent ones of said plurality of electrode members, one of said adjacent ones of said plurality of electrode members defining said second space being adapted to be supplied with a third focus voltage of a fixed value, another of said adjacent ones of said plurality of electrode members defining said second space being adapted to be supplied with said second focus voltage, and said third electrostatic lens being configured so as to increase a focusing action on said plurality of electron beams in both the horizontal and vertical directions with an increasing difference between said third focus voltage and said second focus voltage.

According to another aspect of the present invention, there is provided a cathode ray tube provided with an electron gun having at least an electron beam generating unit for generating a plurality of electron beams arrayed in a horizontal direction and for controlling said plurality of electron beams, comprising a main lens unit comprising a plurality of electrodes including a focus electrode and a final accelerating electrode for focusing said plurality of electron beams onto a. fluorescent screen, said focus electrode comprising a plurality of electrode members, and said final accelerating electrode being disposed downstream of said focus electrode and adapted to be supplied with a first voltage; a final main lens formed between said final accelerating electrode and one of said plurality of electrode members adjacent to said final accelerating electrode; an electrostatic quadrupole lens formed in a first space between adjacent ones of said plurality of electrode members, one of said adjacent ones of said plurality of electrode members defining said first space being adapted to be supplied with a first focus voltage of a fixed value, another of said adjacent ones of said plurality of electrode members defining said first space being adapted to be supplied with a second focus voltage comprised of a fixed voltage and a dynamic voltage varying in synchronism with deflection of said plurality of electron beams, and said electrostatic quadrupole lens being configured so as to focus said plurality of electron beams in one of the horizontal and vertical directions and to diverge said plurality of electron beams in another of the horizontal and vertical directions depending upon which is the higher of said first focus voltage and said second focus voltage; and a third electrostatic lens disposed between said final main lens and said electrostatic quadrupole lens and formed in a second space between adjacent ones of said plurality of electrode members, one of said adjacent ones of said plurality of electrode members defining said second space being adapted to be supplied with a third focus voltage of a fixed value, another of said adjacent ones of said plurality of electrode members defining said second space being adapted to be supplied with said second focus voltage, and said third electrostatic lens being configured so as to increase a focusing action on said plurality of electron beams in both the horizontal and vertical directions with an increasing difference between said third focus voltage and said second focus voltage; and a fourth electrostatic lens formed in a third space between adjacent ones of said plurality of electrode members, said fourth electrostatic lens being a non-axisymmetric lens configured so as to focus said plurality of electron beams in both the horizontal and vertical directions, focusing said plurality of electron beams stronger in the horizontal direction than in the vertical direction.

According to another aspect of the present invention, there is provided a cathode ray tube provided with an electron gun having at least an electron beam generating unit for generating a plurality of electron beams arrayed in a horizontal direction and for controlling said plurality of electron beams, comprising a main lens unit comprising a plurality of electrodes including a focus electrode and a final accelerating electrode for focusing said plurality of electron beams onto a fluorescent screen, said focus electrode comprising a plurality of electrode members, and said final accelerating electrode being disposed downstream of said focus electrode and adapted to be supplied with a first voltage; a final main lens formed between said final accelerating electrode and one of said plurality of electrode members adjacent to said final accelerating electrode for focusing said plurality of electron beams in both the horizontal and vertical directions; an electrostatic quadrupole lens formed in a first space between adjacent ones of said plurality of electrode members, one of said adjacent ones of said plurality of electrode members defining said first space being adapted to be supplied with a first focus voltage of a fixed value, another of said adjacent ones of said plurality of electrode members defining said first space being adapted to be supplied with a second focus voltage comprised of a fixed voltage and a dynamic voltage varying in synchronism with deflection of said plurality of electron beams, and said electrostatic quadrupole lens being configured so as to focus said plurality of electron beams in one of the horizontal and vertical directions and to diverge said plurality of electron beams in another of the horizontal and vertical directions depending upon which is the higher of said first focus voltage and said second focus voltage; and a third electrostatic lens formed in a second space between adjacent ones of said plurality of electrode members, one of said adjacent ones of said plurality of electrode members defining said second space being adapted to be supplied with a third focus voltage of a fixed value, another of said adjacent ones of said plurality of electrode members defining said second space being adapted to be supplied with said second focus voltage, and said third electrostatic lens being configured so as to increase a focusing action on said plurality of electron beams in both the horizontal and vertical directions with an increasing difference between said second focus voltage and said third focus voltage and so as to focus said plurality of electron beams stronger in the horizontal direction than in the vertical direction.

DESCRIPTION OF THE PREFERRED EMBODIMENT

Figure 6:
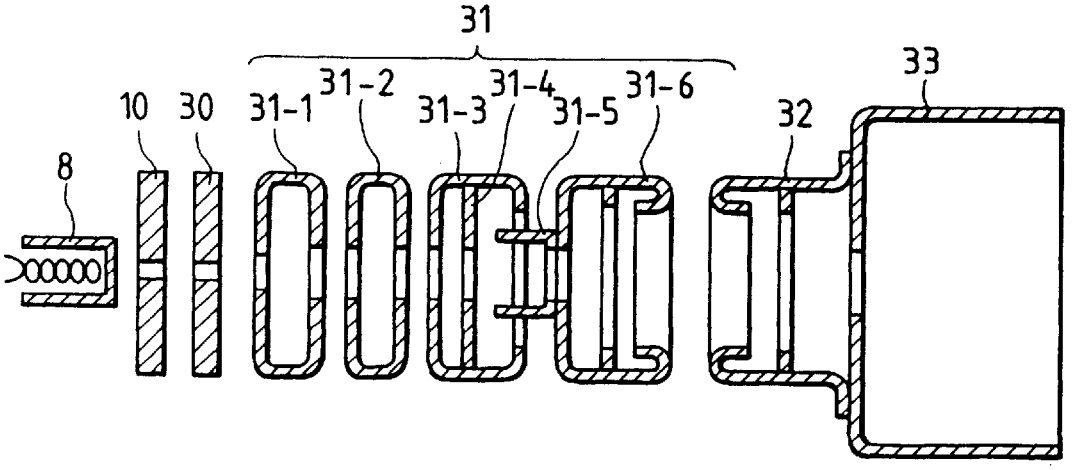
FIG. 6 is a schematic diagram for explaining a structure of an electron gun for improving a correction sensitivity of astigmatism at a low cost without reducing an effect of correcting curvature-of-field.
Figure 5:
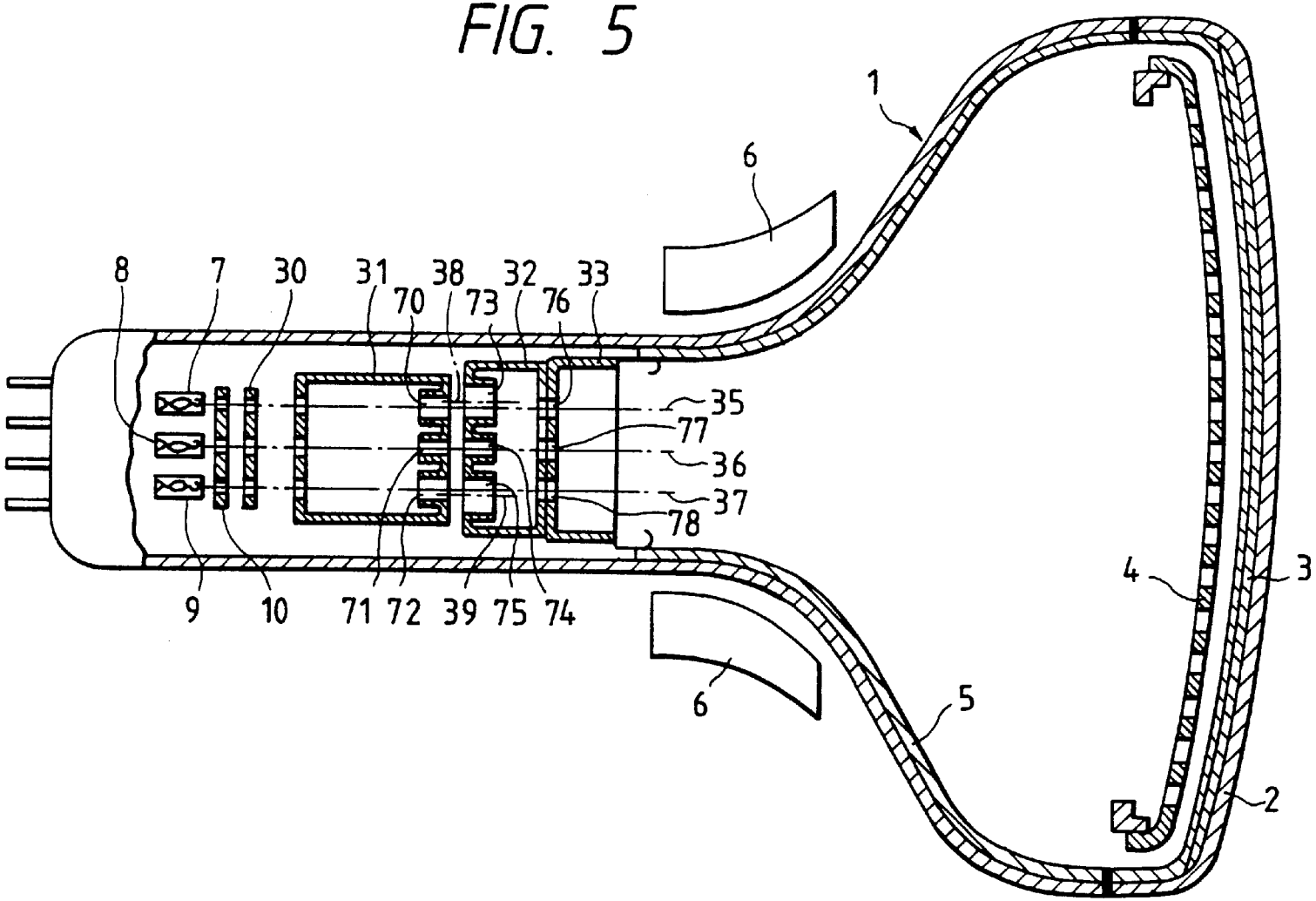
FIG. 5 is a schematic sectional diagram for explaining an example of a structure of a cathode ray tube.

In the conventional technology shown in FIG. 6, at the peripheral portion of the screen in which the dynamic correction voltage increases, in the horizontal direction the astigmatism correction by the electrostatic quadrupole lens has an effect of strengthening the focusing force for the electron beam, and the curvature-of-field correction by the main lens and the added axisymmetric lens has an effect of weakening the focusing force. On the other hand, in the vertical direction, both have an operation of weakening the focusing force for the electron beam.

Accordingly, the two kinds of lenses mutually weaken the effect in the horizontal direction and mutually strengthen it in the vertical direction.

In the construction of the present invention, the curvature-of-field correction lens is rendered to be a non-axisymmetric lens by which the focusing force is strengthened in the horizontal direction and weakened in the vertical direction thereby further compensating for the astigmatism in the vertical direction, improving the sensitivity of the curvature-of-field correction in the horizontal direction, and compensating for a portion of the correcting effect lessened, by the electrostatic quadrupole lens.

In this way, the two kinds of corrections of the astigmatism correction and the curvature-of-field correction can effectively be performed. Therefore, it is not necessary to provide a number of stages of the curvature-of-field correction lenses, and a color cathode ray tube having a high resolution can be provided at a low cost by simplifying the structure of the electron gun.

A detailed explanation will be given to embodiments of the present invention in reference to the drawings as follows.

Figure 1:
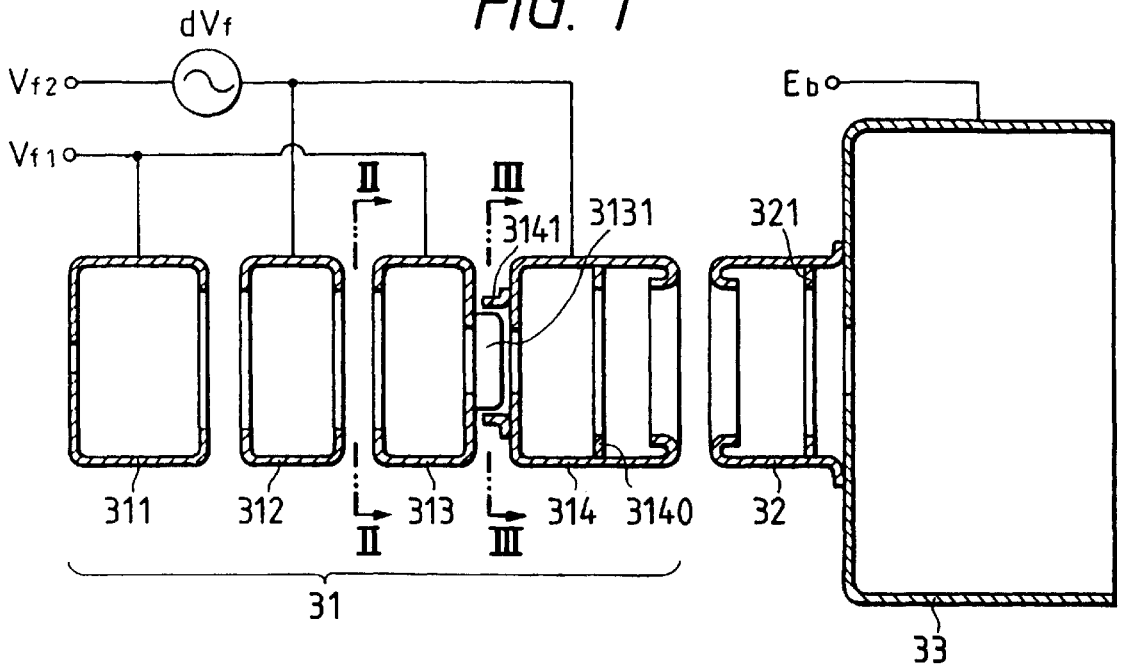
FIG. 1 is a longitudinal sectional diagram of important parts of a main lens unit for explaining a first embodiment of an electron gun provided to a cathode ray tube according to the present invention.
Figure 2:
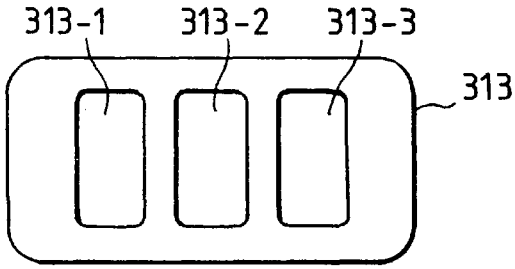
FIG. 2 is a sectional diagram taken along the line II—II of FIG. 1.
Figure 3:
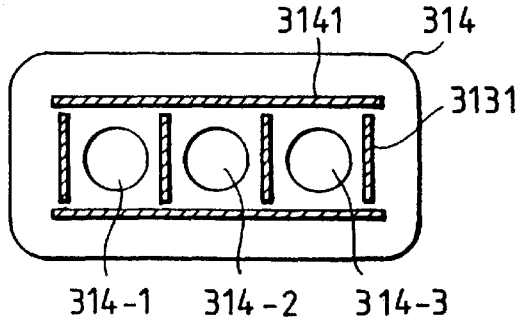
FIG. 3 is a sectional diagram taken along the line III—III of FIG. 1.

FIG. 1 is a longitudinal sectional diagram of important parts of a main lens unit for explaining a first embodiment of an electron gun provided to a cathode ray tube according to the present invention, FIG. 2 is a sectional diagram taken along the line II—II of FIG. 1, and FIG. 3 is a sectional diagram taken along the line III—III of FIG. 1.

In the respective diagrams, numeral 31 designates a third grid electrode composing a focusing electrode, numeral 32 designates a fourth grid electrode composing an accelerating electrode, numeral 33 designates a shield cup electrode. The focusing electrode 31 is composed of a group of electrodes comprising a first electrode member 311, a second electrode member 312, a third electrode member 313 and a fourth electrode member 314.

A constant first focusing voltage Vf1 is applied to the first electrode member 311 and the third electrode member 313, forming a first kind of focusing electrode group.

A second focusing voltage of a combination of a constant voltage Vf2 and a dynamic voltage dVf which changes in synchronism with the deflection of an electron beam is applied to the second electrode member 312 and the fourth electrode member 314, forming a second kind of focusing electrode group.

Further, a final accelerating voltage Eb of 20 through 30 kV is applied to the accelerating electrode 32 and the shield cup electrode 33.

A main lens is formed between the accelerating electrode 32 and the fourth electrode member 314. As has been disclosed in, for instance, Japanese Laid Open Patent Publication No. 103752/1983, the main lens is composed of a single aperture having a large diameter of an opposing face of an electrode, and electrode plates 321 and 3140 which are provided inside of the electrodes and which are provided with electron beam passing holes having an elliptic shape. According to the construction of the main lens, in comparison with a normal cylindrical lens, the lens aberration is reduced and the spot size of the electron beam on the screen can be reduced by the substantially enlarged lens diameter.

Further, in the embodiment of FIG. 1, a strong astigmatism is provided to the main lens wherein a focusing force in the horizontal direction is stronger than that in the vertical direction. In the structure which has been disclosed in the Japanese Laid Open Patent Publication No. 103752/1983, the astigmatism can freely be controlled by changing the positions of the electrode plates 321 and 3140 and the shapes of the electron beam passing holes.

As shown in FIGS. 2 and 3, an electrostatic quadrupole lens is formed in the third electrode member 313 and the fourth electrode member 314 composing the focusing electrode 31, by horizontal correction plates 3141 and vertical correction plates 3131. The structure of the electrostatic quadrupole lens is the same as the one disclosed in Japanese Laid Open Patent Publication No. 250933/1986, corresponding to U.S. Pat. No. Re. 34,399. In this structure, the correction sensitivity of astigmatism can easily be increased by similarly prolonging the horizontal and the vertical correction plates.

Non-axisymmetric lenses are formed between the first electrode member 311 and the second electrode member 312, and between the second electrode member 312 and the third electrode member 313. In this example, a lens having a strong focusing force in the horizontal direction is formed by forming vertical slits 313-1, 313-2 and 313-3 as in the third electrode member 313 shown in FIG. 2, and by mutually opposing them to each other.

Whichever of the electric potentials of the first and third electrode members 311 and 313 or of the second electrode member 312 is higher than the other, when the first electrode member 311 and the second electrode member 312 compose the first slit lens, and the second electrode member 312 and the third electrode member 313 compose the second slit lens, the focusing strength in the horizontal direction is always stronger.

On the other hand, in the electrostatic quadrupole lens, in a case wherein the electric potential of the third electrode member 313 is higher than that of the opposing fourth electrode member 314, the focusing force in the vertical direction is stronger. Conversely, ina case wherein the electric potential of the third electrode member 313 is lower than the electric potential of the opposing electrode, the focusing force in the horizontal direction is stronger.

Figure 4:
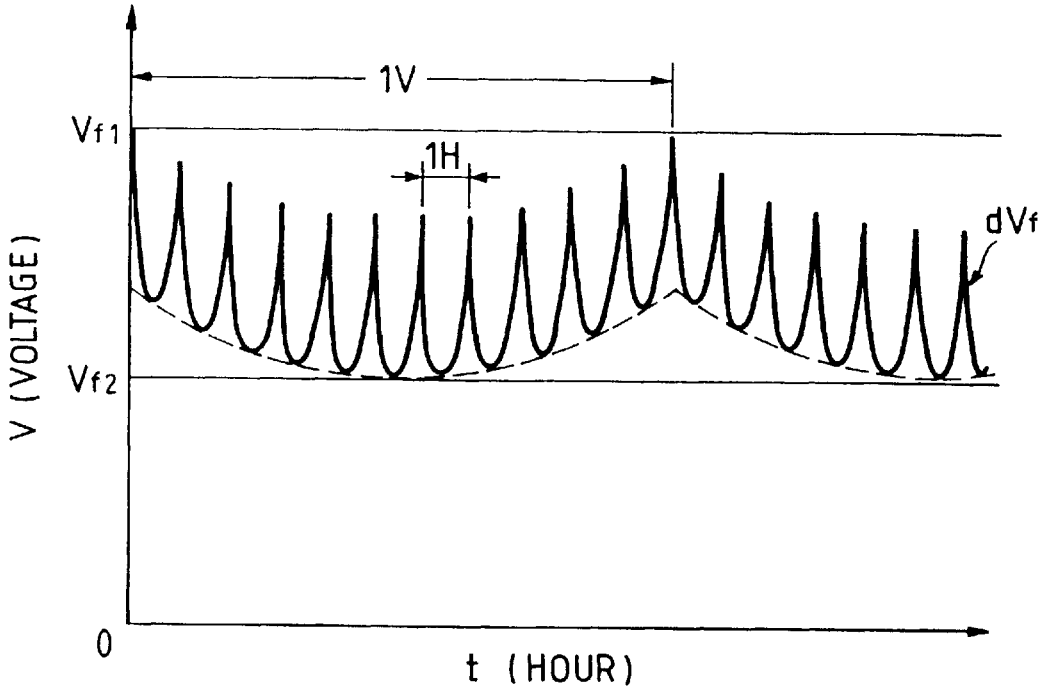
FIG. 4 is an explanatory diagram of a method of operating an electron gun according to the present invention.

FIG. 1 and FIG. 4 are explanatory diagrams of a construction and an operational method of an electron gun having, for instance, the above structure.

In FIG. 1, a first focusing voltage Vf1 of about 7 through 10 kV is applied to the first electrode member 311 and the third electrode member 313 composing a first kind of electrode group which composes the focusing electrode 31.

As shown in FIG. 4, a second focusing voltage of a constant voltage Vf2 of 6 through 9 kV that is lower than the direct voltage component of the first focusing voltage by about 1 kV, which is superposed with a dynamic voltage dVf, is applied to the second electrode member 312 and the fourth electrode member 314 composing a second kind of electrode group.

The dynamic correction voltage dVf has a waveform of a combination of a parabolic waveform having a period of a horizontal deflection period 1H of the electron beam and another parabolic waveform having a period of a vertical deflection period of 1 V. The peak-to-peak value of the dynamic correction voltage dVf is smaller than the difference between Vf1 and Vf2. Accordingly, the electric potential of the first kind of electrode group is always higher than that of the second kind of electrode group.

When the electron beam is not deflected and is at the center portion of the screen, the dynamic correction voltage is null, and the potential difference between the first kind of electrode group and the second kind of electrode group is maximized. Therefore, the lens actions of the electrostatic quadrupole lens and the slit lens are the strongest. At this moment, the astigmatism by the main lens and the slit lens which strongly focuses the electron beam in the horizontal direction, is cancelled by the astigmatism by the electrostatic quadrupole lens which strongly focuses the electron beam in the vertical direction.

When the electron beam is deflected to a corner portion of the screen, the dynamic correction voltage is maximized, and the potential difference between the first kind of electrode group and the second kind of electrode group is near to null. Accordingly, at the corner portion of the screen, the lens actions of both the electrostatic quadrupole lens and the slit lens are almost nullified.

At this moment, the astigmatism by the deflection of the electron beam which strongly focuses the electron beam in the vertical direction, is cancelled by the astigmatism by the main lens which strongly focuses the electron beam in the horizontal direction.

Further, the curvature-of-field aberration at the corner portion of the screen, is corrected by weakening the intensity of the main lens, and is further corrected by weakening of the vertical focusing strength of the quadrupole lens at the corner of the screen which strongly focuses the electron beam in the vertical direction at zero deflection.

Further, the curvature-of-field aberration is also corrected in the horizontal direction by the weakening of the horizontal focusing strength of the slit lens which strongly focuses the electron beam in the horizontal direction at zero deflection.

In this way, the slit lens in this embodiment operates as complementing the effect of correcting the deflection aberration by the electrostatic quadrupole lens, and provides little effect of restraining the effect of the electrostatic quadrupole lens in the vertical direction, as in the above conventional axisymmetric curvature-of-field correction lens. Accordingly, the correction of efficiency is improved.

In comparison with the conventional technology, the deflection aberration is reduced by a simpler structure of the electron gun, and the improvement in the resolution at the peripheral portion of the screen can be achieved.

Further, this invention is not restricted to the color cathode ray tube which has been explained in the above embodiment, and is naturally applicable to a monochromatic cathode ray tube such as a projection type cathode ray tube, or other cathode ray tube.

Figure 7:
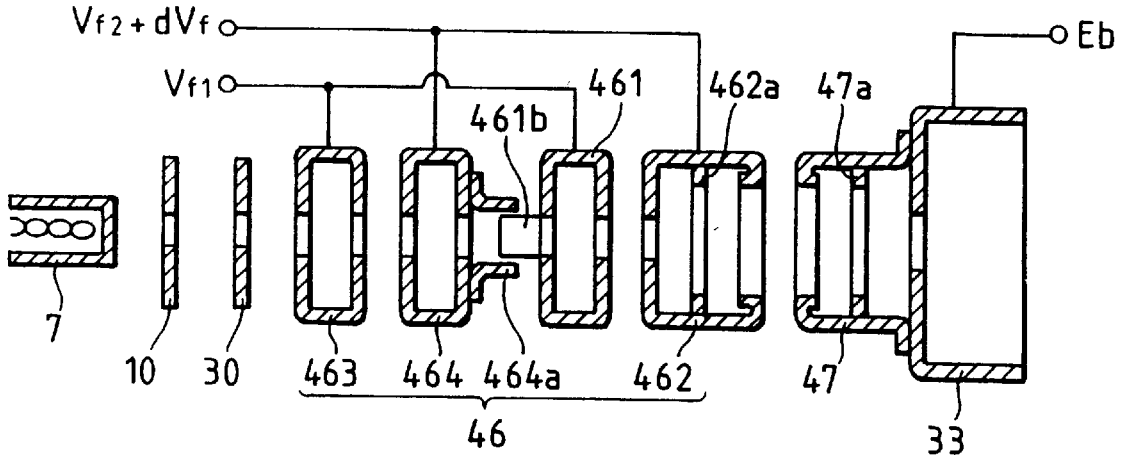
FIG. 7 is a longitudinal sectional diagram for explaining a structure of a second embodiment of an electron gun employed in a cathode ray tube according to the present invention.

FIG. 7 is a longitudinal section diagram for explaining a construction of a second embodiment of an electron gun employed in a cathode ray tube according to the present invention, wherein numeral 7 designates a cathode, numeral 10 designates a first grid electrode, numeral 30 designates a second grid electrode, numeral 46 designates a focusing electrode, numeral 47 designates an accelerating electrode and numeral 33 designates a shield cup.

In FIG. 7, the focusing electrode 46 is composed of a plurality of electrode members 461, 462, 463 and 464. Notations 461*b* and 464*a* designate astigmatism correction electrodes forming an electrostatic guadrupole lens. At the inside of the second electrode member 462, an internal electrode 462*a* is provided which has three electron beams passing holes having the same diameters in a direction in parallel with the horizontal plane and a direction orthogonal to the horizontal plane and which is electrically connected to the second electrode member 462. At the inside of the accelerating electrode 47, a center electron beam passing hole having an aperture or opening of which diameter in the vertical direction is larger than that in the horizontal direction and which is symmetrical in the horizontal direction, and side electron beam passing holes having an opening of which diameter in the vertical direction is larger than that in the horizontal direction and which is asymmetrical in the horizontal direction, are installed.

A triode is composed of the cathode 7, the first grid electrode 10 and the second grid electrode 30, and a main lens is formed between the accelerating electrode 47 on which the highest voltage is applied and the focusing electrode 46.

The focusing electrode 46 juxtaposed to the accelerating electrode 47, is divided into a first electrode member 461, a second electrode member 462, a third electrode member 463 and fourth electrode member 464. Correction electrodes 464*a* and 461*b* which form an astigmatism correction lens, are disposed between the first electrode member 461 and the fourth electrode member 464, and curvature-of-field correction lenses are disposed between the first electrode member 461 and the second electrode member 462, and between the third electrode member 463 and the fourth electrode member 464. Further, the curvature-of-field correction lens formed by the second electrode member 462 and the third electrode member 461 is juxtaposed to the main lens.

A constant voltage of Vf1 is applied to the first electrode member 461 and the third electrode member 463, and a dynamic correction voltage Vf2+dVf which changes in synchronism with a change of a deflection angle of a plurality of electron beams scanning on the screen, is applied to the second focusing electrode member 462 and the fourth electrode member 464.

Figure 8A:
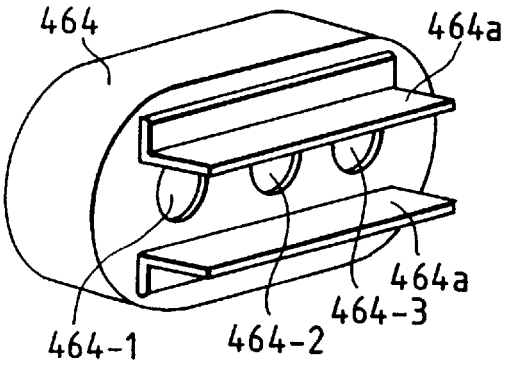
FIGS. 8*a* and 8*b* are explanatory diagrams of an example of a structure of a planar electrode for forming an astigmatism lens in FIG. 7.
Figure 8B:
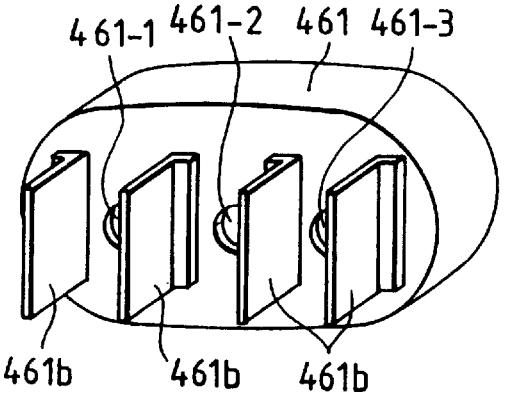

FIGS. 8*a* and 8*b* are explanatory diagrams of an example of a structure of planar electrodes forming an astigmatism lens which is disposed at the opposing portions of the first electrode member 461 and the fourth electrode member 464 composing the focusing electrode, wherein FIG. 8*a* is a perspective diagram of the fourth electrode member, and FIG. 8*b* is that of the first electrode member.

Openings 464-1, 464-2 and 464-3 for passing three electron beams are formed at an end face of the fourth electrode member 464 on the side of the first electrode member 461. A couple of planar electrodes 464*a* stand on the end face on the side of the first electrode member 461, such that they interpose the electron beam passing holes 464-1, 464-2 and 464-3.

Further, three electron beam passing holes 461-1, 461-2 and 461-3 for respectively passing three electron beams, are formed on an end face of the first electrode member 461 on the side of the fourth electrode member 464. A plurality of planar electrodes 461*b* stand on the end face on the side of the fourth electrode member 464 such that they interpose the electron beam passing holes 461-1, 461-2 and 461-3, respectively in the horizontal direction.

These planar electrodes 464*a* and 461*b* constitute an electrode structure which forms an electrostatic quadrupole lens for correcting the astigmatism arranged as shown in FIG. 7, when the both end faces of the first electrode member 461 and the fourth electrode member 464 oppose to each other.

Figure 9A:
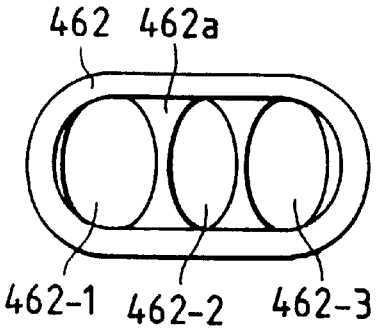
FIGS. 9*a* and 9*b* are front diagrams for explaining examples of shapes of inner electrodes installed respectively inside of a second electrode member composing a focusing electrode and an accelerating electrode.
Figure 9B:
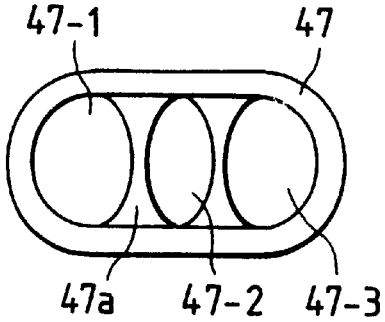

FIGS. 9*a* and 9*b* are front diagrams for explaining examples of shapes of inner electrodes which are installed respectively inside of the second electrode member and the accelerating electrode composing the focusing electrode, wherein FIG. 9*a* shows an inner electrode 462*a* which is installed in the second electrode member, and FIG. 9*b* shows an inner electrode 47*a* which is installed in the accelerating electrode.

As shown in these diagrams, the inner electrodes 462*a* and 47*a* which are respectively installed in the second electrode member 462 and the acceleration electrode 47, are provided with center electron beam passing holes 462-2 and 47-2 respectively having openings of which diameters in the vertical direction are larger than those in the horizontal direction and which are symmetrical in the horizontal direction, and side electron beam passing holes 462-1, 462-3, 47-1 and 47-3 having openings of which diameters in the vertical direction are larger than those in the horizontal direction and which are asymmetric in the horizontal direction.

Generally, in an electron lens for focusing beams emitted from the triode portion, the farther the electron lens is disposed from the triode portion toward the side of the luminescent screen, the stronger the lens effect. Accordingly, the effect of a curvature-of-field correction lens disposed proximate to the triode portion is reduced.

However, in this embodiment, the curvature-of-field correction lens which is the first electron lens, is disposed at a position contiguous to the main lens where the astigmatism correction lens (electrostatic quadrupole lens) which is the second electron lens, was disposed in the previous embodiment, thereby strengthening the correction effect. On the other hand, the correction effect of the astigmatism correction lens can be promoted by improvements in the structure such as increasing the lengths of the planar electrodes and therefore, the correction effect can be maintained even when it is disposed in a region proximate to the triode portion. Therefore, the astigmatism correction lens is disposed remote from the main lens and toward the triode portion compared with the curvature-of-field correction lens.

Figure 10:
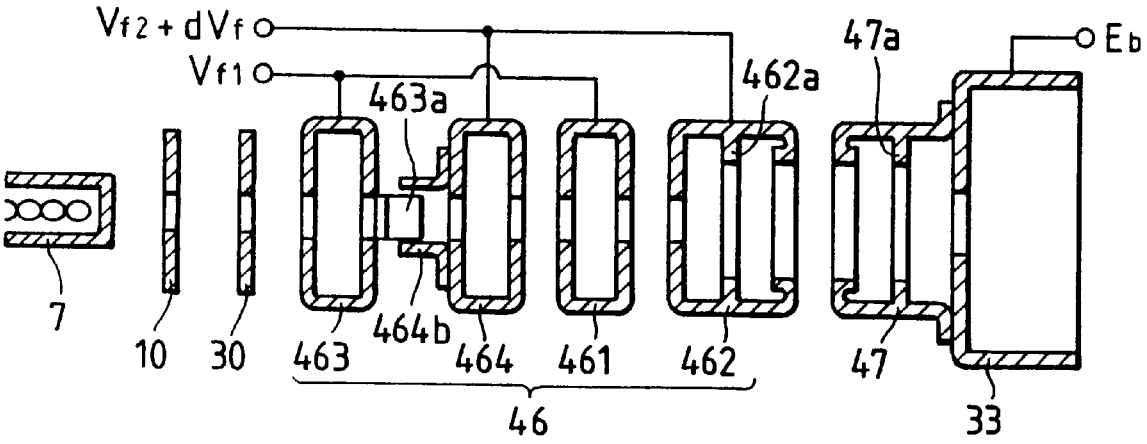
FIG. 10 is a longitudinal sectional diagram for explaining a structure of a third embodiment of an electron gun employed in a cathode ray tube according to the present invention.

FIG. 10 is a longitudinal sectional diagram for explaining a construction of a third embodiment of an electron gun employed in a cathode ray tube according to the present invention, wherein a notation which is the same as that in FIG. 7 corresponds to the same portion.

In FIG. 10, a focusing electrode 46 is divided into a first electrode member 461, a second electrode member 462, a third electrode member 463 and a fourth electrode member 464. Correction electrodes 463*a* and 464*b* which form an astigmatism lens, are disposed between the third electrode member 463 and the fourth electrode member 464. Two curvature-of-field correction lenses composed of the fourth electrode member 464 and the first electrode member 461, and the first electrode member 461 and the second electrode member 462, are disposed in the vicinity of the main lens.

Further, the inner electrode 462*a* disposed in the second focusing electrode 462 and the inner electrode 47*a* disposed in the accelerating electrode 47 are the same as in the former embodiment.

Also by the above construction, the correction effect of the curvature-of-field is promoted, an image having a high resolution is reproduced by favorably focusing the electron beam always over the whole region of the screen, without deteriorating the astigmatism correction effect, and the dynamic focus voltage can be reduced.

Further, an effect of the present invention can be provided in the respective embodiments, even when both the opposing electron beam passing holes of the electrode members composing of the curvature-of-field correction lens are of axisymmetric shapes. Further, the following shapes are pertinent.

Figure 11A:
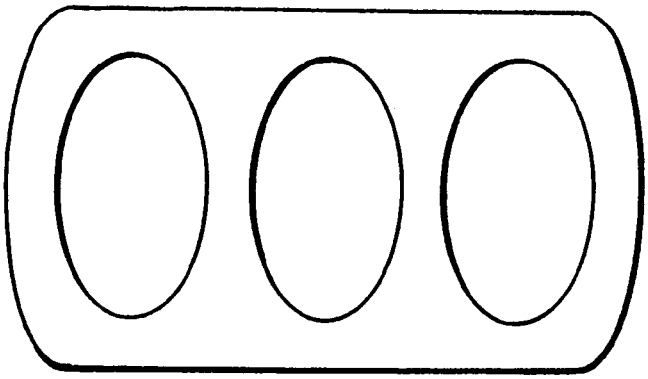
FIGS. 11*a,* 11*b* and 11*c* are explanatory diagrams of examples of shapes of opposing two electron beam passing holes of an electrode member composing a curvature-of-field correction lens.
Figure 11B:
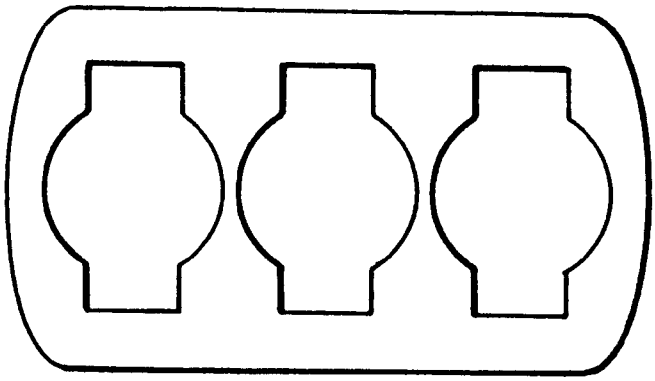
Figure 11C:
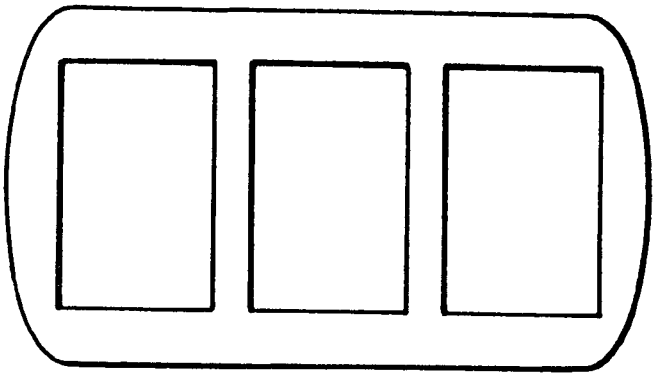

FIGS. 11*a* through 11*c* are explanatory diagrams of examples of shapes of opposing both electron beam passing holes of electrode members composing a curvature-of-field correction lens, wherein, FIG. 11*a* illustrates electron beam passing holes having an elliptic shape with the long axis in the vertical direction, FIG. 11*b* illustrates electron beam passing holes having a vertically elongated rectangular opening overlapped on a circular or vertically elliptical opening, and FIG. 11*c* illustrates electron beam passing holes having a rectangular shape elongated in the vertical direction.

When the curvature-of-field correction lens is axisymmetric, the astigmatism correction by the electrostatic quadrupole lens in the horizontal direction has an effect of strengthening the focusing force for the electron beam, and the curvature-of-field correction by the main lens and the added lens has an effect of weakening the focusing force.

On the other hand, in the vertical direction, either one of the astigmatism correction and the curved image plane correction is in the direction of weakening the focusing force on the electron beam.

Accordingly, the above two kinds of lenses mutually weaken the effect in the horizontal direction, and mutually strengthen in the vertical direction.

Accordingly, the two kinds of the deflection aberration can effectively be corrected by rendering the curvature-of-field correction lens a non-axisymmetric lens with the shapes of the above openings, strengthening the focusing force in the horizontal direction and weakening it in the vertical direction, thereby promoting the sensitivity of the curvature-of-field correction in the horizontal direction and compensating for an amount of the effect is nullified by the electrostatic quadrupole lens.

Further, among the shapes of the openings of the electron beam passing holes shown in FIGS. 11*a* through 11*c,* the assembling is the easiest with the shape in the FIG. 11*b,* which is provided with an advantage wherein an assembly jig which has been employed conventionally, can be utilized as it is.

In the above respective embodiments, the sensitivities in the curvature-of-field correction are different. Therefore, the sensitivity of the curved image plane correction is matched to balance with the sensitivity of the astigmatism correction by the planar electrodes 461*b* and 464*a* (FIG. 7), or the planar electrode 464*a* and 461*b* (FIGS. 8*a* and 8*b*). The application of the focusing voltage remains the same as in FIG. 7.

By these constructions, the curvature-of-field correction effect is promoted, and the dynamic correction voltage for focusing the electron beam always over the whole region of the screen can be reduced.

As explained above, according to the present invention, a cathode ray tube can be provided wherein the correction sensitivity of the deflection aberration can be promoted by a comparatively simple structure of an electron gun, the manufacturing steps of the electron gun is simplified, and the cost reduction of a dynamic voltage forming circuit for correcting the deflection aberration can be achieved.

What is claimed is:

1. A cathode ray tube provided with an electron gun having at least an electron beam generating unit for generating a plurality of electron beams arrayed in a horizontal direction and for controlling said plurality of electron beams, comprising:

a main lens unit comprising a plurality of electrodes including a focus electrode and a final accelerating electrode for focusing said plurality of electron beams onto a fluorescent screen, said focus electrode comprising a plurality of electrode members, and said final accelerating electrode being disposed downstream of said focus electrode and adapted to be supplied with a first voltage;

a final main lens formed between said final accelerating electrode and one of said plurality of electrode members adjacent to said final accelerating electrode;

an electrostatic quadrupole lens formed in a first space between adjacent ones of said plurality of electrode members, one of said adjacent ones of said plurality of electrode members defining said first space being adapted to be supplied with a first focus voltage of a fixed value, another of said adjacent ones of said plurality of electrode members defining said first space being adapted to be supplied with a second focus voltage comprised of a fixed voltage and a dynamic voltage varying in synchronism with deflection of said plurality of electron beams, and said electrostatic quadrupole lens being configured so as to focus said plurality of electron beams in one of the horizontal and vertical directions and to diverge said plurality of electron beams in another of the horizontal and vertical directions depending upon which is the higher of said first focus voltage and said second focus voltage; and a third electrostatic lens disposed between said final main lens and said electrostatic quadrupole lens and formed in a second space between adjacent ones of said plurality of electrode members, one of said adjacent ones of said plurality of electrode members defining said second space being adapted to be supplied with said first focus voltage, another of said adjacent ones of said plurality of electrode members defining said second space being adapted to be supplied with said second focus voltage, and said third electrostatic lens being configured so as to increase a focusing action on said plurality of electron beams in both the horizontal and vertical directions with an increasing difference between said first focus voltage and said second focus voltage.

2. The cathode ray tube according to claim 1, wherein said third electrostatic lens is adjacent to said final main lens.

3. The cathode ray tube according to claim 1, wherein said third electrostatic lens focuses said plurality of electron beams stronger in the horizontal direction than in the vertical direction.

4. The cathode ray tube according to claim 3, wherein each of said opposing portions of said adjacent ones of said plurality of electrode members defining said second space is formed with an opening having a vertical diameter thereof larger than a horizontal diameter thereof.

5. The cathode ray tube according to one of claims 1 to 4, wherein said electrostatic quadrupole lens and said third electrostatic lens are configured so as to cancel each other in lens action in the horizontal direction and so as to reinforce each other in lens action in the vertical direction with variation of said second focus voltage.

6. The cathode ray tube according to one of claims 1 to 4, wherein said another of said adjacent ones of said plurality of electrode members defining said first space is provided with a plurality of horizontal plate-like electrodes sandwiching a path of said plurality of electron beams in said first space.

7. The cathode ray tube according to claim 6, wherein said second focus voltage is lower than said first focus voltage at least when said plurality of electron beams are not deflected.

8. The cathode ray tube according to claim 7, wherein said one of said adjacent ones of said plurality of electrode members defining said first space is provided with a plurality of vertical plate-like electrodes sandwiching a path of said plurality of electron beams in said first space.

9. The cathode ray tube according to claim 1, wherein said final main lens focuses said plurality of electron beams in both the horizontal and vertical directions, focusing said plurality of electron beams stronger in the horizontal direction than in the vertical direction.

10. A cathode ray tube provided with an electron gun having at least an electron beam generating unit for generating a plurality of electron beams arrayed in a horizontal direction and for controlling said plurality of electron beams, comprising:

a main lens unit comprising a plurality of electrodes including a focus electrode and a final accelerating electrode for focusing said plurality of electron beams onto a fluorescent screen, said focus electrode comprising a plurality of electrode members, and said final accelerating electrode being disposed downstream of said focus; electrode and adapted to be supplied with a first voltage;

a final main lens formed between said final accelerating electrode and one of said plurality of electrode members adjacent to said final accelerating electrode;

an electrostatic quadrupole lens formed in a first space between adjacent ones of said plurality of electrode members, one of said adjacent ones of said plurality of electrode members defining said first space being adapted to be supplied with a first focus voltage of a fixed value, another of said adjacent ones of said plurality of electrode members defining said first space being adapted to be supplied with a second focus voltage comprised of a fixed voltage and a dynamic voltage varying in synchronism with deflection of said plurality of electron beams, and said electrostatic quadrupole lens being configured so as to focus said plurality of electron beams in one of the horizontal and vertical directions and to diverge said plurality of electron beams in another of the horizontal and vertical directions depending upon which is the higher of said first focus voltage and said second focus voltage; and a third electrostatic lens disposed between said final main lens and said electrostatic quadrupole lens and formed in a second space between adjacent ones of said plurality of electrode members, one of said adjacent ones of said plurality of electrode members defining said second space being adapted to be supplied with said first focus voltage, another of said adjacent ones of said plurality of electrode members defining said second space being adapted to be supplied with said second focus voltage, and said third electrostatic lens being configured so as to increase a focusing action on said plurality of electron beams in both the horizontal and vertical directions with an increasing difference between said first focus voltage and said second focus voltage; and a fourth electrostatic lens formed in a third space between adjacent ones of said plurality of electrode members, said fourth electrostatic lens being a non-axisymmetric lens configured so as to focus said plurality of electron beams in both the horizontal and vertical directions, focusing said plurality of electron beams stronger in the horizontal direction than in the vertical direction.

11. The cathode ray tube according to claim 10, wherein said third electrostatic lens is adjacent to said final main lens.

12. The cathode ray tube according to claim 10, wherein said third electrostatic lens focuses said plurality of electron beams stronger in the horizontal direction than in the vertical direction.

13. The cathode ray tube according to claim 12, wherein each of opposing portions of said adjacent ones of said plurality of electrode members defining said second space is formed with an opening having a vertical diameter thereof larger than a horizontal diameter thereof.

14. The cathode ray tube according to claim 10 wherein said electrostatic quadrupole lens and said third electrostatic lens are configured so as to cancel each other in lens action in the horizontal direction and so as to reinforce each other in lens action in the vertical direction with variation of said second focus voltage.

15. The cathode ray tube according to claim 10, wherein said another of said adjacent ones of said plurality of electrode members defining said first space is provided with a plurality of horizontal plate-like electrodes sandwiching a path of said plurality of electron beams in said first space.

16. The cathode ray tube according to claim 15, wherein said second focus voltage is lower than said first focus voltage at least when said plurality of electron beams are not deflected.

17. The cathode ray tube according to claim 16, wherein said one of said adjacent ones of said plurality of electrode members defining said first space is provided with a plurality of vertical plate-like electrodes sandwiching a path of said plurality of electron beams in said first space.

18. A cathode ray tube provided with an electron gun having at least an electron beam generating unit for generating a plurality of electron beams arrayed in a horizontal direction and for controlling said plurality of electron beams, comprising:

a main lens unit comprising a plurality of electrodes including a focus electrode and a final accelerating electrode for focusing said plurality of electron beams onto a fluorescent screen, said focus electrode comprising a plurality of electrode members, and said final accelerating electrode being disposed downstream of said focus electrode and adapted to be supplied with a first voltage;

a final main lens formed between said final accelerating electrode and one of said plurality of electrode members adjacent to said final accelerating electrode for focusing said plurality of electron beams in both the horizontal and vertical directions;

an electrostatic quadrupole lens formed in a first space between adjacent ones of said plurality of electrode members, one of said adjacent ones of said plurality of electrode members defining said first space being adapted to be supplied with a first focus voltage of a fixed value, another of said adjacent ones of said plurality of electrode members defining said first space being adapted to be supplied with a second focus voltage comprised of a fixed voltage and a dynamic voltage varying in synchronism with deflection of said plurality of electron beams, and said electrostatic quadrupole lens being configured so as to focus said plurality of electron beams in one of the horizontal and vertical directions and to diverge said plurality of electron beams in another of the horizontal and vertical directions depending upon which is the higher of said first focus voltage and said second focus voltage; and a third electrostatic lens formed in a second space between adjacent ones of said plurality of electrode members, one of said adjacent ones of said plurality of electrode members defining said second space being adapted to be supplied with said first focus voltage, another of said adjacent ones of said plurality of electrode members defining said second space being adapted to be supplied with said second focus voltage, and said third electrostatic lens being configured so as to increase a focusing action on said plurality of electron beams in both the horizontal and vertical directions with an increasing difference between said second focus voltage and said first focus voltage and so as to focus said plurality of electron beams stronger in the horizontal direction than in the vertical direction.

19. The cathode ray tube according to claim 18, wherein each of opposing portions of said adjacent ones of said plurality of said electrode members defining said second space is formed with an opening having a vertical diameter thereof larger than a horizontal diameter thereof.

20. The cathode ray tube according to claim 18, wherein said electrostatic quadrupole lens and said third electrostatic lens are configured so as to cancel each other in lens action in the horizontal direction and so as to reinforce each other in lens action in the vertical direction with variation of said second focus voltage.

21. The cathode ray tube according to claim 18, wherein said electrostatic quadrupole lens is disposed adjacent to said final main lens.

22. The cathode ray tube according to claim 18, wherein said another of said adjacent ones of said plurality of electrode members defining said first space is provided with a plurality of horizontal plate-like electrodes sandwiching a path of said plurality of electron beams in said first space.

23. The cathode ray tube according to claim 22, wherein said second focus voltage is lower than said first focus voltage at least when said plurality of electron beams are not deflected.

24. The cathode ray tube according to claim 23, wherein said one of said adjacent ones of said plurality of electrode members defining said first space is provided with a plurality of vertical plate-like electrodes sandwiching a path of said plurality of electron beams in said first space.

25. The cathode ray tube according to claim 1, wherein said first voltage supplied to the final accelerating electrode is higher than each of the first and second focus voltages.

26. The cathode ray tube according to claim 10, wherein said first voltage supplied to the final accelerating electrode is higher than each of the first and second focus voltages.

27. The cathode ray tube according to claim 18, wherein said first voltage supplied to the final accelerating electrode is higher than each of the first and second focus voltages.

28. A cathode ray tube according to claim 1, wherein a difference between said first focus voltage and said second focus voltage is maximum when said plurality of electron beams; are not deflected.

29. A cathode ray tube according to claim 10, wherein a difference between said first focus voltage and said second focus voltage is maximum when said plurality of electron beams are not deflected.

30. A cathode ray tube according to claim 18, wherein a potential difference between said first focus voltage and said second focus voltage is maximum when said plurality of electron beams are not deflected.

* * * * *